US005642634A

United States Patent [19]

Perry

[11] Patent Number: 5,642,634

[45] Date of Patent: Jul. 1, 1997

[54] APPARATUS FOR SECURING A COMPUTER CASE

[76] Inventor: Robert C. Perry, 5755 SW. Willow La., Lake Oswego, Oreg. 97035-5340

[21] Appl. No.: 647,376

[22] Filed: May 9, 1996

[51] Int. Cl.[6] ..... E05B 73/00

[52] U.S. Cl. ..... 70/18; 70/58; 70/164; 70/170; 248/552

[58] Field of Search ..... 70/57.1, 164, 18, 70/30, 49, 57, 58, 14, 76, 158, 163, 166, 167, 170, 171; 361/683; 248/551, 552; 312/216; 364/708.1

[56] References Cited

U.S. PATENT DOCUMENTS

| | | | |
|---|---|---|---|
| 555,829 | 3/1896 | Rogers | 70/57 X |
| 4,028,913 | 6/1977 | Falk | 70/58 |
| 4,065,946 | 1/1978 | Loynes et al. | 70/58 |
| 4,418,551 | 12/1983 | Kochackis | 70/18 |
| 4,488,624 | 12/1984 | Myers | 70/49 X |
| 4,656,848 | 4/1987 | Rose | 70/58 |
| 4,733,840 | 3/1988 | D'Amore | 70/18 X |
| 4,738,341 | 4/1988 | Asano | 70/18 X |
| 4,955,501 | 9/1990 | Hodge | 70/164 X |
| 5,052,198 | 10/1991 | Watts | 70/58 |
| 5,351,507 | 10/1994 | Derman | 70/58 X |

FOREIGN PATENT DOCUMENTS

| | | | |
|---|---|---|---|
| 174161 | 3/1953 | Germany | 70/49 |
| 2725580 | 12/1977 | Germany | 70/58 |
| 2725843 | 12/1977 | Germany | 70/18 |
| 192777 | 2/1923 | United Kingdom | 70/18 |

*Primary Examiner*—Lloyd A. Gall
*Attorney, Agent, or Firm*—Smith-Hill and Bedell

[57] ABSTRACT

A securing apparatus for a personal computer system unit comprises a tough, flexible, elongate cable having two regions spaced apart along the length of the cable. A security connector connects two spaced apart regions of the cable together to form a strap that extends around the system unit. A guide element is secured to the cover or the base of the system unit and guides the strap relative to the system unit and prevents removal of the strap from the system unit.

20 Claims, 2 Drawing Sheets

APPARATUS FOR SECURING A COMPUTER CASE

BACKGROUND OF THE INVENTION

This invention relates to apparatus for securing a computer case.

A conventional personal computer has a system unit that comprises a chassis or frame having a front panel through which access may be had to disk drive bays, a rear panel at which connectors are provided for connection to peripheral devices, and a base that connects the rear panel to the front panel and supports the main board of the system unit. A cover is attached to the chassis by screws and guide elements that require that the cover be displaced in a direction from the front panel toward the rear panel in order to disengage the cover from the chassis. The cover has two vertical side walls and a horizontal wall connecting the upper edges of the two side walls.

It is just a few minutes work for a thief having a screw driver to remove the cover from the chassis of a conventional personal computer, whether of desk top or tower style, and pocket several hundred dollars' worth of integrated circuit chips and modules.

SUMMARY OF THE INVENTION

In accordance with a first aspect of the invention there is provided a personal computer system unit comprising a chassis having a front panel, a rear panel, and a base that connects the rear panel to the front panel, a cover that fits to the chassis and is releasably secured thereto by at least one screw, the cover having a top wall and two side walls and engaging the chassis in a manner such that on removing the screw, the cover is removed from the chassis by displacing it in a direction parallel to the top wall and the side walls, and a securing apparatus for preventing unauthorized removal of the cover from the chassis, said securing apparatus comprising a tough, flexible, elongate cable having two regions spaced apart along the length of the cable, a security connector connecting the two spaced apart regions of the cable together to form a strap that extends around the system unit, the strap having a first length segment that passes across the rear panel of the chassis, a second length segment that passes under the base of the chassis, and at least a third segment connecting the first segment and the second segment, and a guide means secured to the cover or the base and guiding the strap relative to the system unit and preventing removal of the strap from the system unit.

In accordance with a second aspect of the invention there is provided a personal computer system unit comprising a chassis having a front panel, a rear panel, and a base that connects the rear panel to the front panel, a cover that fits to the chassis and is releasably secured thereto by at least one screw, the cover having a top wall and two side walls and engaging the chassis in a manner such that on removing the screw, the cover is removed from the chassis by displacing it in a direction parallel to the top wall and the side walls, and a securing apparatus for preventing unauthorized removal of the cover from the chassis, said securing apparatus comprising a tough, flexible, elongate cable having two regions spaced apart along the length of the cable, a security connector connecting the two spaced apart regions of the cable together to form a strap that extends around the system unit, the strap having a first length segment that passes across the front panel of the chassis, a second length segment that passes across the rear panel, and at least a third segment connecting the first segment and the second segment, and a guide means secured to the cover or the chassis and guiding the strap relative to the system unit and preventing removal of the strap from the system unit.

In accordance with a third aspect of the invention there is provided a personal computer system unit comprising a chassis having a front panel, a rear panel, and a base that connects the rear panel to the front panel, a cover that fits to the chassis and is releasably secured thereto by at least one screw, the cover having a top wall and two side walls and engaging the chassis in a manner such that on removing the screw, the cover is removed from the chassis by displacing it in a direction parallel to the top wall and the side walls, and a securing apparatus for preventing unauthorized removal of the cover from the chassis, said securing apparatus comprising a tough, flexible, elongate cable having two regions spaced apart along the length of the cable, a security connector connecting the two spaced apart regions of the cable together to form a strap that extends around the system unit, the strap having a first length segment that passes over the top wall of the cover, a second length segment that passes under the base of the chassis, and at least a third segment connecting the first segment and the second segment, and a guide means secured to the cover or the chassis and guiding the strap relative to the system unit and preventing removal of the strap from the system unit.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
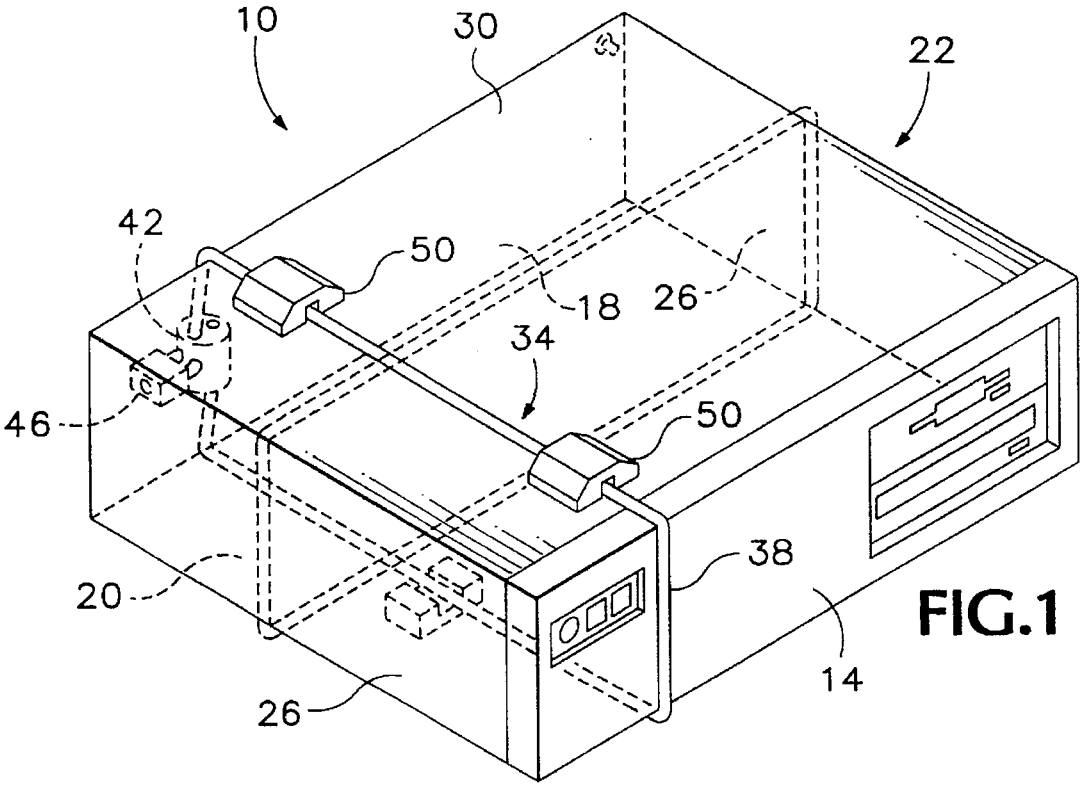
FIG. 1 is a front perspective view of a first personal computer system unit provided with a securing apparatus in accordance with the present invention.

FIG. 1 shows a personal computer system unit 10 which is of the desktop style and has a footprint of approximately 40 cm from side to side and approximately 40 cm from front to back. The system unit 10 comprises a chassis having a front panel 14, a rear panel 18 and a base 20. A cover 22 is fitted to the chassis. The cover has two vertical sidewalls 26 and a horizontal top wall 30 connecting the upper edges of the two sidewalls. The cover has a flange (not shown) that extends partially over the rear panel of the chassis, and screws, only one of which is shown in FIG. 1, are fitted through holes in the flange and engage internally threaded holes in the rear panel, so as to secure the cover to the chassis. The cover has a lip at the forward end of the top wall lodged in a slot that extends along the top of the front panel. In order to remove the cover non-destructively from the chassis, the screws are removed and the cover is shifted backward relative to the chassis so as to withdraw the lip from the slot. The cover can then be removed from the chassis.

In order to prevent unauthorized removal of the cover from the chassis, a strap 34 is provided that extends around the system unit 10. The strap 34 comprises a cable 38 have a quarter-inch diameter steel core coated with PVC to a thickness of 5/16 inch. Preferably, the core is composed of 343 individual steel filaments in a 7×7×7 configuration: 7 individual filaments are twisted together to form a thread, 7 threads are twisted together to form a strand, and 7 strands are twisted together to form the cable core.

Figure 2:
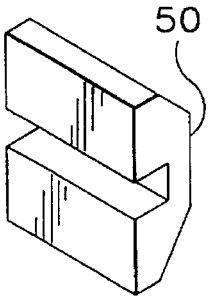
FIG. 2 is a perspective view of a first component of the securing apparatus shown in FIG. 1.

The cable 38 extends over the top of the cover, down the 30 front panel, and under the base of the chassis, and the two ends of the cable are joined at the rear panel by a lockable connector 42, which may be a termination device of the kind shown in U.S. Pat. No. 5,481,888, equipped with a padlock 46. The padlock may be keyed, as shown, or it may be a combination padlock. The strap 34 is positioned so that it does not interfere with access to the disk drives or controls at the front panel of the system unit or with the connectors at the rear panel of the system unit. The cable is preferably positioned to one side, as shown in FIG. 1, to allow a monitor to be placed flat on top of the system unit. However, if the base of the monitor is provided with suitable feet, the monitor can be positioned so that it straddles the cable. The cable passes through channels in two cable guide elements 50 that are made of a tough injection molded synthetic polymer material and are bonded to the top wall of the cover using an adhesive having good gap filling properties, such as the adhesive that is sold under the trademark RIGHT-ON by Securtech Co. of Lake Oswego, Oreg. The cable guide elements 50, one of which is shown in FIG. 2, prevent removal of the strap by sliding it off the system unit to one side or the other.

By use of a termination device of the kind shown in U.S. Pat. No. 5,481,888 to secure the ends of the cable together, the length of the strap can be adjusted to take account of the actual dimensions of the system unit, particularly the height of the system unit.

Figure 3:
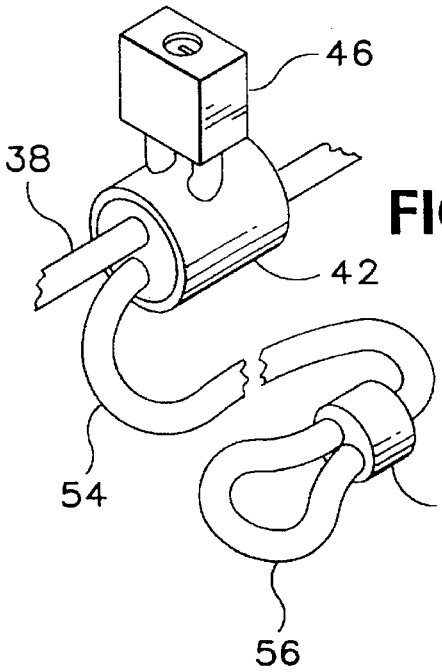
FIG. 3 is a perspective view of a second component of the securing apparatus shown in FIG. 1, and also illustrates an optional attachment loop.

As described thus far, the strap interferes with unauthorized removal of the cover of the system unit from the chassis. In order to prevent unauthorized removal of the entire system unit, the cable may be made substantially longer than needed to extend around the system unit, so that it has a free end portion 54 (FIG. 3) extending from the connector 42, and the free end portion may be provided with a loop 56, either by crimping a ferrule 58, as shown in FIG. 3, or by using a second termination device of the kind shown in U.S. Pat. No. 5,481,888. However formed, the loop 56 can be used to attach the cable to an element that is effectively fixed in position, such as a desk or table.

Figure 5:
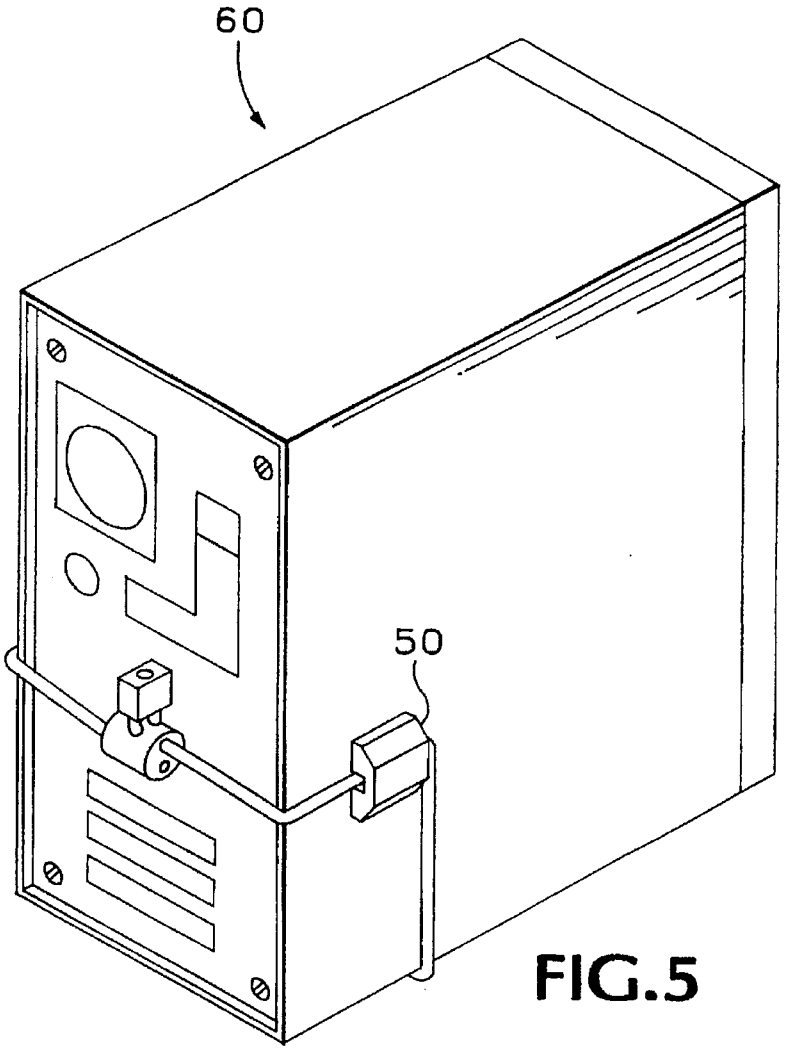
FIG. 5 is a rear perspective view of the system unit shown in FIG. 4.
Figure 4:
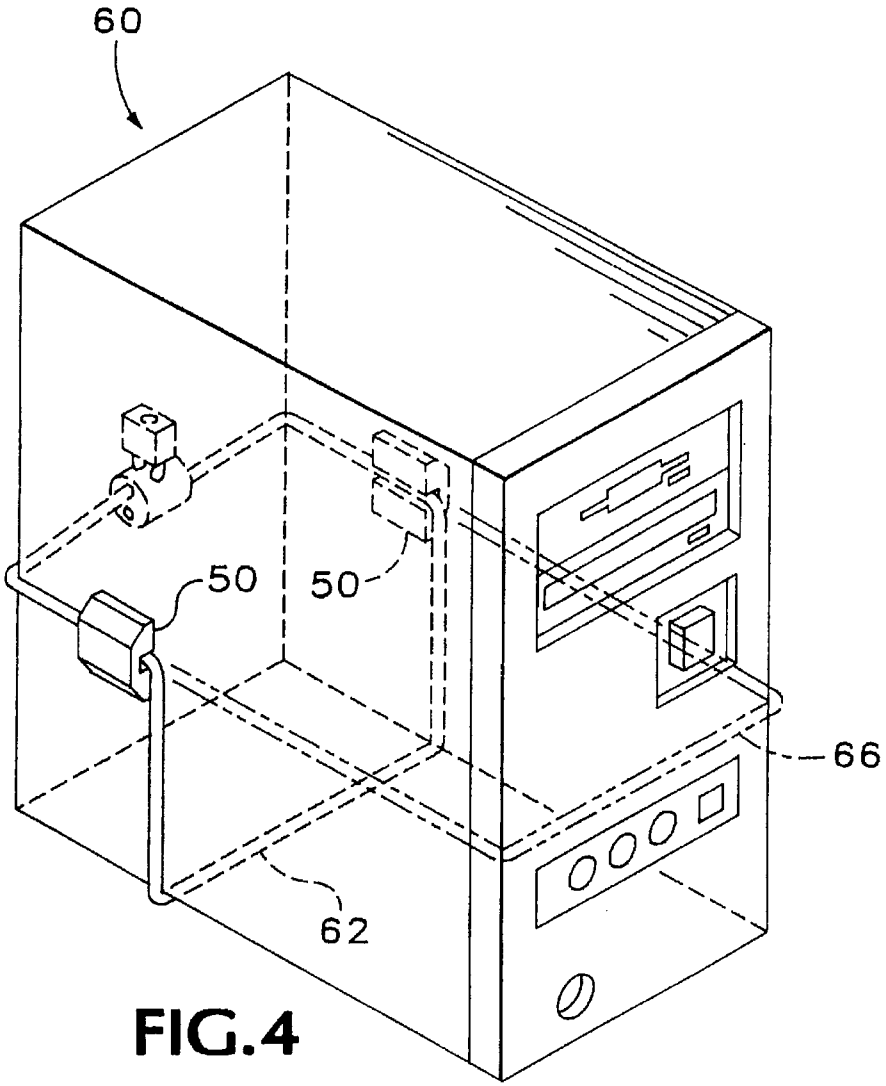
FIG. 4 is a front perspective view of a second personal computer system unit provided with a securing apparatus in accordance with the present invention.

FIGS. 4 and 5 show use of a securing apparatus in accordance with the invention to secure a system unit 60 of the tower style. The ends of the cable are connected together at the rear panel of the system unit 60 by the lockable connector 42, as in the case of FIGS. 1–3. The strap extends horizontally across the rear panel and passes forward along the two opposite sidewalls through the cable guide elements 50, which are secured to the two sidewalls respectively. Forward of the cable guide elements 50, the cable may extend under the chassis, as shown at 62, or it may extend across the front panel, as shown at 66, depending on whether the cover is removed from the chassis by moving it forwards or backwards relative to the chassis. In either case, the cable may be longer than needed to extend around the system unit 60, so as to provide a free end that can be used to secure the system unit against unauthorized removal, as described with reference to FIG. 3.

It will be appreciated that the invention is not restricted to the particular embodiments that have been described in detail, and that variations may be made therein without departing from the scope of the invention as defined in the appended claims and equivalents thereof. For example, the cable could pass over the top wall, down one sidewall, under the base, and up the other sidewall, as shown schematically in dashed lines in FIG. 1. Such a configuration could be used to prevent removal of a cover that was designed to be removed by lifting the cover upward from the chassis. It might be desirable that the guide elements, which could be similar to the guide elements 50 shown in FIG. 1, be attached to the base of the chassis, or that one guide element be attached to the chassis and one to the cover. The guide elements could then serve as feet. If it should be desired that the guide elements be attached to the base of the chassis, the purpose of the guide elements (guiding the strap and preventing removal from the system unit) may be served by the conventional feet placed at the corners of the base, provided that the cable is sufficiently taut that it cannot readily be slipped over the feet and thereby removed.

I claim:

1. In combination, a personal computer system unit comprising a chassis having a front panel, a rear panel, and a base that connects the rear panel to the front panel, and a cover that fits to the chassis and is releasably secured thereto by at least one screw, the cover having a top wall and two side walls and engaging the chassis in a manner such that on removing the screw, the cover can be removed from the chassis by displacing the cover relative to the chassis, and a securing apparatus for preventing unauthorized removal of the cover from the chassis, said securing apparatus comprising a tough, flexible, elongate cable having two regions spaced apart along the length of the cable, a security connector connecting the two spaced apart regions of the cable together to form a strap that extends around the system unit, the strap having a first length segment that passes across the rear panel of the chassis, a second length segment that passes under the base of the chassis, and at least a third length segment connecting the first segment and the second segment, and a guide means secured to the cover or the chassis and guiding the strap relative to the system unit and preventing removal of the strap from the system unit.

2. A combination according to claim 1, wherein the security connector is a lockable connector.

3. A combination according to claim 1, wherein the first length segment is composed of two partial segments that include the two spaced apart regions respectively.

4. A combination according to claim 1, wherein the third length segment passes across the front panel and the strap further comprises a fourth length segment that passes over the top of the cover from the front panel to the rear panel.

5. A combination according to claim 1, wherein the strap has a fourth length segment connecting the first length segment and the second length segment, and the third and fourth length segments extend across respective side walls of the cover.

6. A combination according to claim 5, wherein each of the third and fourth length segments includes a portion that extends upward from the base of the chassis and a portion that extends forward from the rear panel.

7. A combination according to claim 1, wherein the guide means comprises two guide elements secured to the side walls respectively.

8. A combination according to claim 1, wherein the guide means comprises at least one guide element secured to the top wall of the cover.

9. In combination, a personal computer system unit comprising a chassis having a front panel, a rear panel, and a base that connects the rear panel to the front panel, and a cover that fits to the chassis and is releasably secured thereto by at least one screw, the cover having a top wall and two side walls and engaging the chassis in a manner such that on removing the screw, the cover can be removed from the chassis by displacing the cover relative to the chassis, and a securing apparatus for preventing unauthorized removal of the cover from the chassis, said securing apparatus comprising a tough, flexible, elongate cable having two regions spaced apart along the length of the cable, a security connector connecting the two spaced apart regions of the cable together to form a strap that extends around the system unit, the strap having a first length segment that passes across the front panel of the chassis, a second length segment that passes across the rear panel, and at least a third length segment connecting the first segment and the second segment, and a guide means secured to the cover or the chassis and guiding the strap relative to the system unit and preventing removal of the strap from the system unit.

10. A combination according to claim 9, wherein the security connector is a lockable connector.

11. A combination according to claim 9, wherein the second length segment is composed of two partial segments that include the two spaced apart regions respectively and have the first and third length segments therebetween.

12. A combination according to claim 9, wherein the strap has a fourth length segment connecting the first length segment and the second length segment, and the third and fourth length segments extend across respective side walls of the cover.

13. A combination according to claim 9, wherein the guide means comprises two guide elements secured to the side walls respectively.

14. A combination according to claim 9, wherein the guide means comprises at least one guide element secured to the top wall of the cover.

15. In combination, a personal computer system unit comprising a chassis having a front panel, a rear panel, and a base that connects the rear panel to the front panel, and a cover that fits to the chassis and is releasably secured thereto by at least one screw, the cover having a top wall and two side walls and engaging the chassis in a manner such that on removing the screw, the cover can be removed from the chassis by displacing the cover relative to the chassis, and a securing apparatus for preventing unauthorized removal of the cover from the chassis, said securing apparatus comprising a tough, flexible, elongate cable having two regions spaced apart along the length of the cable, a security connector connecting the two spaced apart regions of the cable together to form a strap that extends around the system unit, the strap having a first length segment that passes over the top wall of the cover, a second length segment that passes under the base of the chassis, and at least a third length segment connecting the first segment and the second segment, and a guide means secured to the cover or the chassis and guiding the strap relative to the system unit and preventing removal of the strap from the system unit.

16. A combination according to claim 15, wherein the security connector is a lockable connector.

17. A combination according to claim 15, wherein the third length segment passes across the front panel and the strap further comprises a fourth length segment that passes across the rear panel.

18. A combination according to claim 15, wherein the strap has a fourth length segment connecting the first length segment and the second length segment, and the third and fourth length segments extend across respective side walls of the cover.

19. A combination according to claim 15, wherein the guide means comprises at least one guide element secured to the base of the chassis.

20. A combination according to claim 15, wherein the guide means comprises at least one guide element secured to the top wall of the cover.

* * * * *